United States Patent [19]

Akisawa

[11] Patent Number: 4,953,252

[45] Date of Patent: Sep. 4, 1990

[54] ROLL SURFACE CLEANING DEVICE

[75] Inventor: Taiji Akisawa, Kanagawa, Japan

[73] Assignee: Fuji Photo Film Co., Ltd., Kanagawa, Japan

[21] Appl. No.: 410,445

[22] Filed: Sep. 21, 1989

[30] Foreign Application Priority Data

Sep. 22, 1988 [JP] Japan ..... 63-237979

[51] Int. Cl.[5] ..... D21G 9/00

[52] U.S. Cl. ..... 15/308; 15/51; 15/256.51; 15/309.1; 101/425

[58] Field of Search ..... 15/308, 309, 256.51, 15/256.53, 302, 51; 101/425

[56] References Cited

U.S. PATENT DOCUMENTS

| | | | |
|---|---|---|---|
| 2,728,103 | 12/1955 | Benedict et al. | 15/256.53 X |
| 4,344,361 | 8/1982 | MacPhee et al. | 101/425 |
| 4,369,544 | 1/1983 | Parisi | 15/320 |
| 4,433,451 | 2/1984 | Parisi | 15/51 X |
| 4,845,794 | 7/1989 | Korski et al. | 15/51 |
| 4,852,209 | 8/1989 | Svenka et al. | 15/308 |

*Primary Examiner*—Chris K. Moore

*Attorney, Agent, or Firm*—Sughrue, Mion, Zinn, Macpeak & Seas

[57] ABSTRACT

A roll surface cleaning device for cleaning a roll surface includes a cleaning material strip which is softer than the roll surface and is in a continuous length. The cleaning material strip is fed out from a feed-out roll and is taken up by a takeup roll. Between the feed-out roll and the takeup roll, the cleaning material strip is pressed against the roll surface by a pressing mechanism and captures dirt on the roll surface. A first sucking mechanism applies suction force to the portion of the cleaning material strip pressed against the roll surface so that the dirt which has been captured on the cleaning material strip is removed therefrom or is embedded therein by suction. A vibration generator imparts fine vibration to the pressing mechanism. A second sucking mechanism is provided between the first sucking mechanism and the takeup roll and applies suction force to the cleaning material from the side opposite to the side which is pressed against the roll surface.

1 Claim, 3 Drawing Sheets

ROLL SURFACE CLEANING DEVICE

BACKGROUND OF THE INVENTION

1. Field of the Invention

This invention relates to a device for cleaning the surface of a roll which is used in a supercalender, laminator, film forming machine or the like.

2. Description of the Prior Art

When rolling or calendering magnetic tape, paper, films and the like, dirt adheres to the surface of the rolls of the rolling or calendering machine (a supercalender, laminator, film forming machine or the like) in a short time. Since the finishing requirements is generally severe in the processings by the supercalender, the laminator and the film forming machine, the dirt on the roll surface deteriorates the evenness of the roll surface and can result in nonconforming articles. Thus this applicant has proposed a roll surface cleaning device which cleans the roll surface while the rolling or the calendering process is on. See Japanese Unexamined Patent Publication No. 63(1988)-66394.

In the roll surface cleaning device, a cleaning material strip which is softer than the roll surface and is in a continuous length is fed out from a feed-out means and is taken up by a takeup means. Between the feed-out means and the takeup means, the cleaning material strip is pressed against the roll surface by a pressing means and captures dirt on the roll surface. The portion of the cleaning material strip pressed against the roll surface is exposed to suction force so that the dirt which has been captured on the cleaning material strip is removed therefrom or is embedded therein by suction.

However, the roll surface cleaning device is not sufficient in cleaning force since the cleaning material strip is simply pressed against the roll surface, and cannot remove dirt having strong adhesion to the roll surface. Further, though the dirt transferred to the cleaning material strip is removed from the strip or embedded in in the strip by suction, the part of the dirt embedded in the strip can fall off the strip before the strip is taken up by the takeup means and can contaminate the product.

SUMMARY OF THE INVENTION

In view of the foregoing observations and description, the primary object of the present invention is to provide a roll surface cleaning device which can clean the roll surface more effectively and in which the dirt transferred to the cleaning material strip is prevented from falling off the cleaning material strip.

The roll surface cleaning device in accordance with the present invention is of the type described above and characterized by having a vibration generating means which imparts fine vibration to the pressing means which presses the cleaning material to the roll surface, and an additional suction means which is provided between the aforesaid suction means and the takeup means and applies suction force to the cleaning material from the side opposite to the side which is pressed against the roll surface The vibration generating means improves the cleaning effect and the additional suction means prevents the dirt transferred to the cleaning material from falling off. The frequency and the direction of said fine vibration may be freely selected so long as it can improve the cleaning effect of the cleaning material while keeping the cleaning material in close contact with the roll surface.

DESCRIPTION OF THE PREFERRED EMBODIMENT

Figure 1:
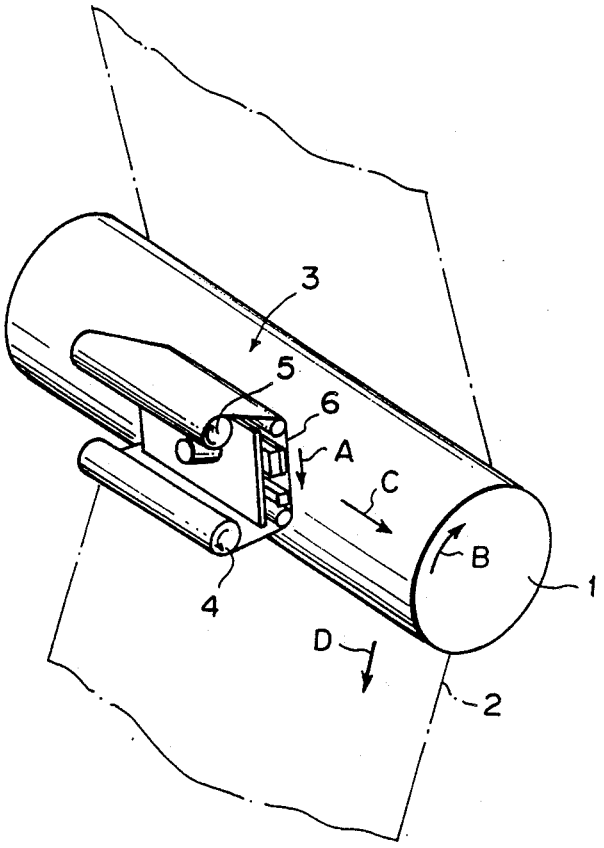
FIG. 1 is a schematic perspective view showing a roll surface cleaning device in accordance with an embodiment of the present invention together with a roll to be cleaned by the device.

In FIG. 1, a roll 1 calenders a web 2 (e.g., magnetic tape) which is fed out from a web feed-out means (not shown) and taken up by a web takeup means (not shown). The web 2 is run in the direction of arrow D and is brought into contact with the roll 1 which is rotated in the direction of arrow B. A cleaning device 3 in accordance with an embodiment of the present invention is opposed to the side of the roll 1 diametrically opposed to the side in contact with the web 2.

The cleaning device 3 includes a takeup roll 4, a feed-out roll 5 and a cleaning material strip 6 in a continuous length. The cleaning material strip 6 is fed out from the feed-out roll 5 and is taken up by the takeup roll 4, and is thus run in the direction of arrow A while being brought into contact with the surface of the roll 1. The cleaning material strip 6 may be formed of nonwoven fabric such as of rayon or other synthetic fibers, for instance. In this particular embodiment, the width of the cleaning material strip 6 is smaller than that of the length of the roll 1, and the cleaning material strip 6 is moved in the longitudinal direction of the roll 1 as shown by arrow C and is brought into contact with the roll 1 over the entire length thereof. Though the means for moving the cleaning material strip 6 in the direction of the arrow C is not shown, the moving means disclosed in Japanese Unexamined Patent Publication No. 63(1988)-66394 may be used for instance. The width of the cleaning material strip 6 may be equal to the length of the roll 1, and in this case, the cleaning material strip 6 need not be movable in the direction of the arrow C.

Figure 2:
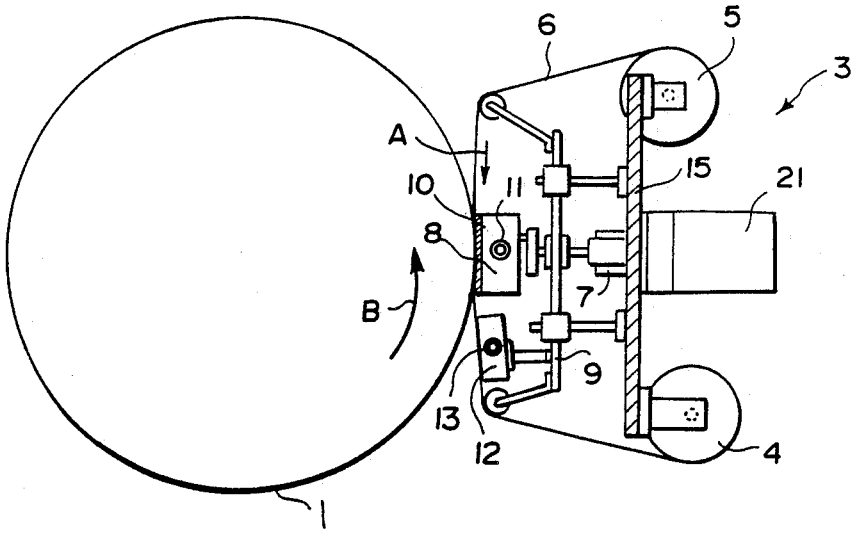
FIGS. 2 and 3 are cross-sectional views of the roll surface cleaning device.
Figure 3:
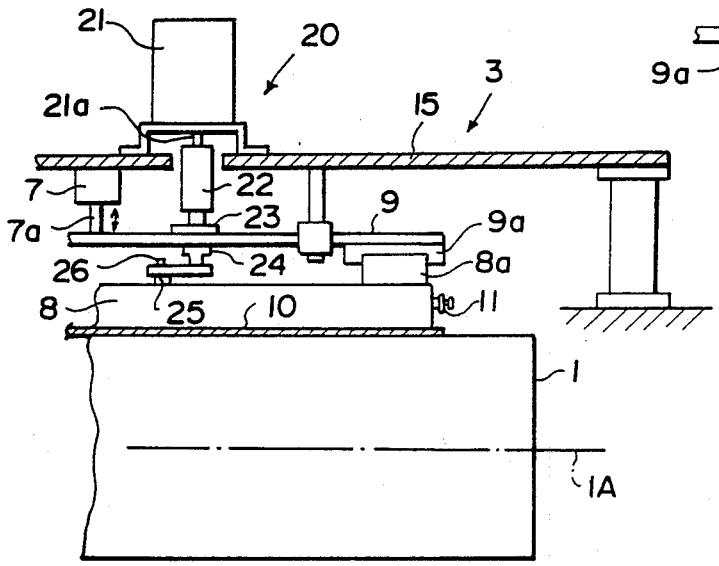
Figure 4:
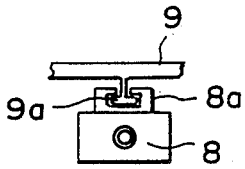
FIG. 4 is a schematic view showing the slide mechanism employed in the roll surface cleaning device.

With reference to FIGS. 2 and 3, the cleaning device 3 further includes a pressing means which presses the cleaning material strip 6 against the surface of the roll 1 under a predetermined pressure. The pressing means comprises a first suction box 8 which extends in the transverse direction of the cleaning material strip 6, and air cylinder 7 having a rod 7*a*, and a support plate 9 having a pair of slide shafts 9*a*. The slide shafts 9*a* are provided respectively on opposite end portions of the lower surface (as seen in FIG. 3) of the support plate 9, and are respectively engaged with a pair of slide bearings 8*a* provided on the upper surface of the first suction box 8. The slide shaft 9*a* and the slide bearing 8*a* are as shown in FIG. 4 in shape. When the rod 7*a* of the air cylinder 7 is extended, the force applied to the first suction box 8 by way of the support plate 9 is increased, and the pressure at which the cleaning material strip 6 is pressed against the surface of the roll 1 is increased, and vice versa.

A rubber lining 10 having a number of through holes is mounted on the side of the first suction box 8 which is brought into contact with the cleaning material strip 6. A joint 11 is mounted on one side of the first suction box 8 and the inside of the box 8 is communicated with a vacuum source (not shown) by way of the joint 11.

The cleaning device 3 in accordance with this embodiment further includes a second suction box 12 which is provided downstream of the first suction box 8 and applies suction force to the cleaning material strip 6 from the side opposite to the side which is pressed against the roll 1. The second suction box 12 has a number of through holes on the side which is brought into contact with the cleaning material strip 6, and a joint 13 which communicates the inside of the suction box 12 with a vacuum source (not shown) is mounted on one side of the suction box 12. Since the second suction box 12 need not press the cleaning material strip 6, the side which is brought into contact with the cleaning material strip 6 has a highly smooth plated surface.

Figure 5:
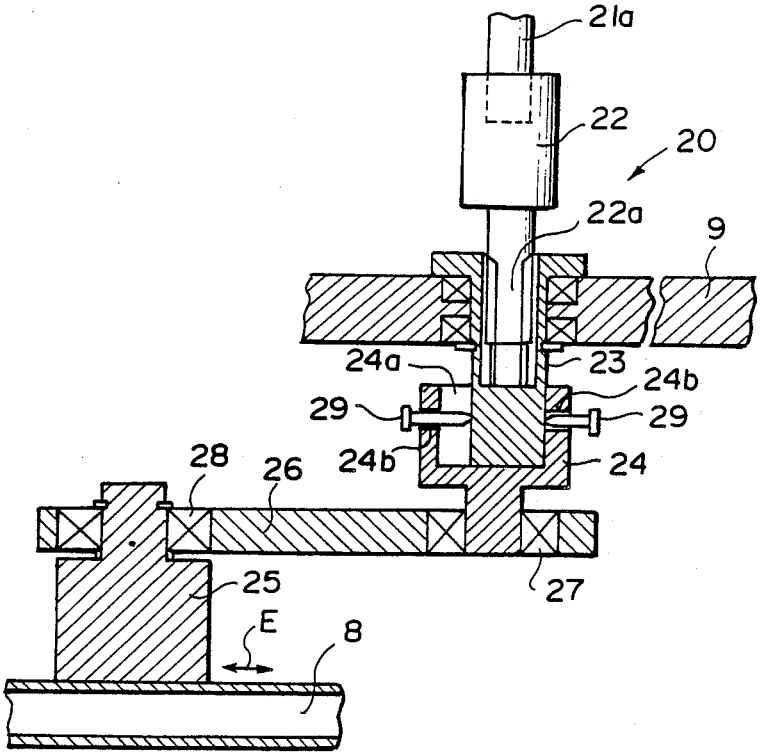
FIG. 5 is a cross-sectional view of the vibration generating means employed in the roll surface cleaning device.
Figure 6:
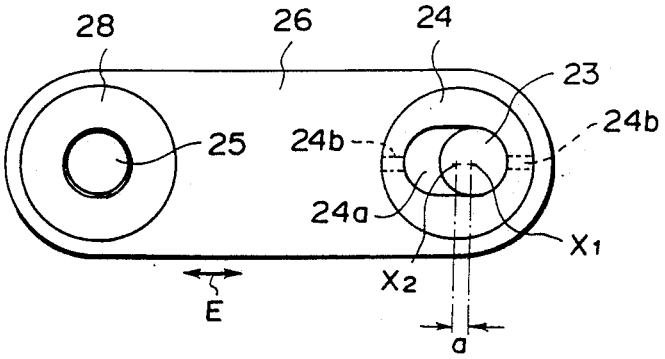
FIG. 6 is a schematic view showing the connecting plate employed in the roll surface cleaning device.

The first suction box 8 vibrates and imparts fine vibrations to the cleaning material strip 6. With reference to FIGS. 3, 5 and 6, vibration generating means 20 for vibrating the first suction box 8 will be described, hereinbelow.

The vibration generating means 20 comprises a motor 21 which is fixed to a stationary plate 15 (to which said air cylinder 7 is fixed) and has an output shaft 21*a*, a rotational shaft 22 which is drivingly engaged with the output shaft 21*a* of the motor 21 and has a lower end portion which forms a male spline member 22*a* , a female spline member 23 which is in mesh with the male spline member 22*a*, an eccentric rotational portion 24 having an elongated hole 24*a* into which the female spline member 23 is inserted, a fixed shaft 25 fixed to the first suction box 8, and a connecting plate 26 which connects the eccentric rotational portion 24 and the fixed shaft 25 by way of bearings 27 and 28. By virtue of the male spline member 22*a* and the female spline member 23, the support plate 9 (which supports for rotation the female spline member 23) can be moved up and down as seen in FIG. 5 without affecting the motor 21.

When the rotational shaft 22 is rotated by the motor 21 and the female spline member 23 is rotated by way of the male spline member 22*a*, the eccentric rotational portion 24 is eccentrically rotated integrally with the female spline member 23. That is, the female spline member 23 is fixed to the eccentric rotational portion 24 by a pair of bolts 29 screwed into threaded holes 24*b* formed in opposed sides of the eccentric rotational portion 24. The female spline member 23 is positioned with respect to the eccentric rotational portion 24 so that the central axis X1 of the female spline member 24 deviates from the central axis X2 of the eccentric rotational portion 24 by a predetermined distance a as shown in FIG. 6. When the female spline member 23 is rotated in this state, the eccentric rotational portion 24 is eccentrically rotated about the central axis X1 of the female spline member 23 two-dimensionally in the plane shown in FIG. 6. The eccentric rotation of the eccentric rotational portion 24 is transmitted to the connecting plate 26. The vertical component of the eccentric rotation is absorbed by rotation of the connecting plate 26 about the fixed shaft 25, and the connecting plate 26 transmits only the lateral component (in the direction of arrow E) which cannot be absorbed to the fixed shaft 25 and moves it. Accordingly, the first suction box 8 is moved back and forth in the direction of the arrow E, whereby the cleaning material strip 6 between the first suction box 8 and the roll 1 is moved back and forth in a direction parallel to the rotational axis of the roll 1. Since the slide bearing 8*a* on the first suction box 8 is in engagement with the slide shaft 9*s* as described above, the first suction box 8 is moved back and forth correctly in the direction parallel to the central axis of the roll 1. The the period of the vibration can be changed by changing the rotational speed of the motor 21, and the amplitude of the vibration can be changed by changing the position of the female spline member 23 in the elongated hole 24*a* or the deviation a of the central axis X1 from the central axis X2.

The operation of the cleaning device 3 of this embodiment will be described hereinbelow.

While the web 2 is being calendered by the roll 1, the cleaning material strip 6 is run at a predetermined speed. The roll 1 is rotated at 300m/min at the maximum, for instance, and the cleaning material strip 6 is run at about 1 to 100mm/min, for instance. The rod 7*a* of the air cylinder 7 is extended and the first suction box 8 is pushed toward the roll 1, whereby the cleaning material strip 6 between the first suction box 8 and the roll 1 is pressed against the roll surface under a predetermined pressure which is preferably 150 to 700gr/cm (line pressure). At the same time, the first suction box 8 is finely vibrated in the direction parallel to the rotational axis 1A of the roll 1 as described above. The frequency of the vibration is preferably 5 to 200Hz. Since the cleaning material strip 6 is run opposite to the rotation of the roll 1 and is pressed against the roll 1 while vibrated, an excellent cleaning effect can be obtained and even dirt which has firmly adhered to the roll surface can be removed. At the position at which the cleaning material strip 6 is pressed against the roll 1, suction force is applied to the cleaning material strip 6 through the first suction box 8. Since the cleaning material strip 6 is of nonwoven fabric as described above, the dirt transferred to the cleaning material strip 6 from the roll surface is sucked into the box 8 or into the cleaning material strip 6. This prevents the dirt removed from the roll surface by the cleaning material strip 6 from floating around the roll 1. The second suction box 12 further applies suction force to the cleaning material strip 6 which runs away the cleaning position, thereby preventing the dirt captured by the cleaning material strip 6 from scattering and adhering to the web 2, the roll 1 and the like.

The cleaning material strip 6 may be formed any suitable material so long as it can transmit suction force therethrough and can clean the roll surface without damaging the roll surface. For example, it may be formed of paper, long fiber fabric or the like.

Further, solvent or the like may be sprayed on the roll surface before the roll surface is brought into contact with the cleaning material strip 6 so that further improved cleaning effect can be obtained. Further, the first suction box 8 may be pressed against the roll surface by means other than the air cylinder. For example, it may pressed against the roll surface under the force of a spring. The cleaning material strip 6 may be run in the same direction as the direction of rotation of the roll 1 or may be run in perpendicular to the direction of rotation of the same. Further, the direction of the fine vibration may be changed according to the running direction of the cleaning material strip 6 or the like.

When a plurality of rolls are used, each roll may be cleaned by use of a cleaning device of this embodiment.

I claim:

1. A roll surface cleaning device for cleaning the surface of a roll used in a supercalender, a laminator, a film forming machine or the like comprising, a cleaning material strip which is softer than the roll surface and is in a continuous length, a feedout means which feeds out the cleaning material strip, a takeup means which takes up the cleaning material strip, a pressing means which presses the cleaning material strip against the roll surface between the feed-out means and the takeup means, a vibration generating means which imparts fine vibration to the pressing means, a first suction means which applies suction force to the cleaning material strip from behind at the portion which is pressed against the roll surface and a second suction means which is provided between the first suction means and the takeup means and applies suction force to the cleaning material from the side opposite to the side which is pressed against the roll surface.

* * * * *